United States Patent [19]

Murakami et al.

[11] Patent Number: 5,065,967

[45] Date of Patent: Nov. 19, 1991

[54] SEAT DEVICE FOR VERY SMALL SIZE SHOVEL CAR

[75] Inventors: Yoshiaki Murakami; Seiji Nishihara, both of Ehime, Japan

[73] Assignee: Kabushiki Kaisha Kobe Seiko Sho, Kobe, Japan

[21] Appl. No.: 549,116

[22] Filed: Jul. 6, 1990

[30] Foreign Application Priority Data

Jul. 13, 1989 [JP] Japan ..... 1-180824

[51] Int. Cl.[5] ..... F16M 11/00

[52] U.S. Cl. ..... 248/161; 296/65.1; 297/344

[58] Field of Search ..... 248/161, 291, 293; 296/65.1, 63, 68.1; 114/363; 180/330, 331; 297/344, 345, 346

[56] References Cited

U.S. PATENT DOCUMENTS

| | | | |
|---|---|---|---|
| 1,268,800 | 6/1918 | Stuck | 296/65.1 |
| 1,525,743 | 2/1925 | Jack | 296/65.1 |
| 1,593,477 | 7/1926 | Speyer | 296/65.1 |
| 2,318,751 | 5/1943 | Carlson | 296/65.1 |
| 2,514,249 | 7/1950 | Madsen | 296/65.1 X |
| 2,565,666 | 8/1951 | Schaefer | 296/65.1 X |
| 2,700,411 | 1/1955 | Lamb | 296/65.1 X |
| 2,984,311 | 5/1961 | Wehsley | 180/330 X |
| 3,642,088 | 2/1972 | Smith | 297/345 X |
| 3,841,696 | 10/1974 | Wagner | 297/346 X |
| 4,712,968 | 12/1987 | Manning | 180/331 X |

*Primary Examiner*—J. Franklin Foss

*Attorney, Agent, or Firm*—Oblon, Spivak, McClelland, Maier & Neustadt

[57] ABSTRACT

A seat device for a very small size shovel car which does not extend, when it is not used, rearwardly from a car body of the shovel car to improve the handling facility and the operability of the shovel car. The seat device includes a support element mounted at a rear lower portion of the car body and a support post mounted on the support element for pivotal motion around a horizontal axis or an obliquely rearwardly inclined axis between an operative position in which it is directed upwardly rearwardly and a seat face of a seat mounted at the top end thereof is directed upwardly to allow an operator to be seated thereon and an inoperative position in which the support post extends vertically upwardly along the car body and the seat face of the seat is directed rearwardly. The support post is secured at each of the operative and inoperative positions.

10 Claims, 3 Drawing Sheets

SEAT DEVICE FOR VERY SMALL SIZE SHOVEL CAR

BACKGROUND OF THE INVENTION

1. Field of the Invention

This invention relates to a seat device for a very small size shovel car, and more particularly to a seat device for a very small shovel car wherein, when the seat is not used, it is retracted from a predetermined position so that it may not form an obstruction to an operation of the shovel car.

2. Description of the Related Art

A very small size shovel car has not be put into practical use which can be transported into a narrow alley or the like to perform civil engineering working such as ditch excavation. However, if it is intended to produce such very small size shovel car, then it can be considered that a cage should not be provided on such shovel car but a seat should provided at a rear portion of a car body of the shovel car in order to reduce the car body to be as small as possible.

Since such seat for a very small size shovel car extends rearwardly from the car body, the seat will form make an obstruction upon transportation or the like of the very small size shovel car by a transporting vehicle. Meanwhile, since the very small size shovel car is provided on the assumption that it is used for a narrow working area as a condition in use, it may be sometimes necessary to make a rear overhang as small as possible.

SUMMARY OF THE INVENTION

Accordingly, it is an object of the present invention to provide a seat device for a very small size shovel car which does not extend, when it is not used, rearwardly from a car, body of the shovel car to improve the handling facility and the operability of the shovel car.

In order to achieve the object, according to the present invention, there is provided a seat device for a very small size shovel car wherein an operating boom is mounted for pivotal motion on a front portion of a car body while an engine and a transmission case are mounted on a rear portion of the car body, which comprises a support element mounted at a rear lower portion of the car body, a seat, a support post having the seat secured to the top end thereof, the support post being mounted on the support element for pivotal motion between an operative position in which the support post is directed upwardly rearwardly and a seat face of the seat is directed upwardly to allow an operator to be seated thereon and an inoperative position in which the support post extends vertically upwardly along the car body of the shovel car and the seat face of the seat is directed rearwardly, and securing means for securing the support post at the operative and inoperative positions.

With the seat device, the support element for the support post for the seat is located at the rear lower portion of the car body of the very small size shovel car. The support post mounted on the support element extends rearwardly upwardly and is formed such that an operator may be seated on the seat mounted at the top end of the support post in order to operate the very small size shovel car.

The support post can be pivoted forwardly from the operative position to the inoperative position in which it extends vertically upwardly along the car body and the seat is located near a rear portion of the car body and the seat face of the seat is directed rearwardly. At the inoperative position, the support post can be secured by the securing means.

In this instance, the support post may be mounted for pivotal motion either around a horizontal axis at a top end portion of the support element or around an obliquely rearwardly inclined axis provided by the support element. Where the support post is mounted for pivotal motion around a horizontal axis, when the seat device is not to be used, the support post is pivoted forwardly from the operative to the inoperative position around the horizontal axis and then secured by the securing means together with the seat, with the seat face directed rearwardly. On the other hand, where the support post is mounted for pivotal motion around an obliquely rearwardly inclined axis, an upper portion of the support post may be bent obliquely laterally with respect to the other lower portion of the support post which extends along the obliquely rearwardly inclined axis. Thus, when the seat device is not to be used, the support post is pivoted by 180 degrees in the clockwise or counterclockwise direction around the obliquely rearwardly inclined axis whereupon the seat is turned over from a position at which an operator can be seated on the seat to another position near the rear wall of the car body, and the seat is then secured to such folded position together with the support post by the securing means.

Since the seat which extends rearwardly from the car body when the support post is at the operative position can be folded as described above, it will not reduce the mobility of the shovel car in a narrow working area or the like. Further, since the seat in the folded position has its seat face directed rearwardly to an operator, even if the operator collides in error with the seat, there is no possibility of an injury or the like, and the safety is assured.

The above and other objects, features and advantages of the present invention will become apparent from the following description and the appended claims.

DETAILED DESCRIPTION OF THE PREFERRED EMBODIMENTS

Figure 1:
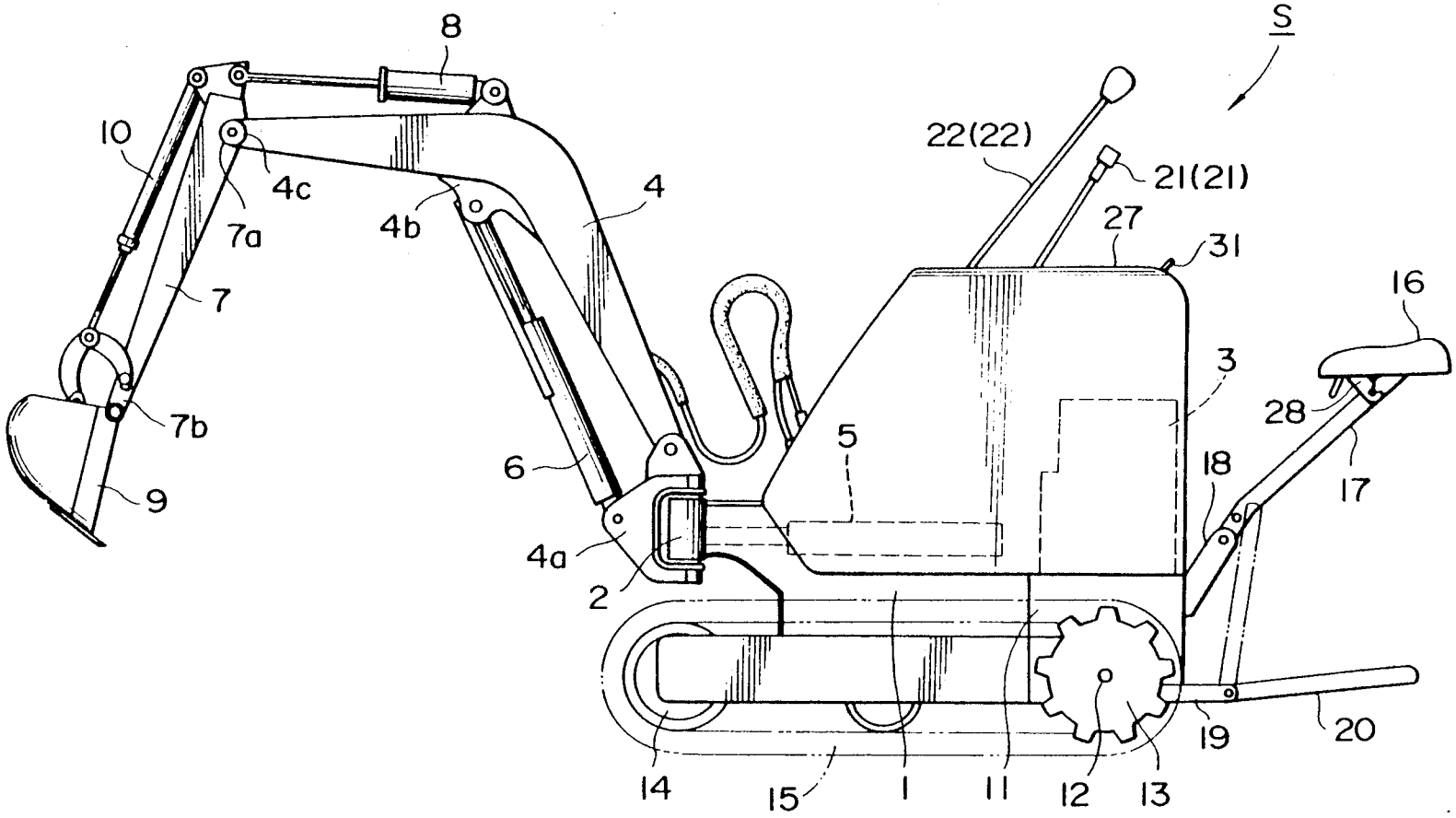
FIG. 1 is a side elevational view of a very small size shovel car in which a seat device according to the present invention is incorporated.

Referring first to FIG. 1, there is shown a very small size shovel car in which a seat device according to the present invention is incorporated. The very small size shovel car is generally denoted at S and includes a frame 1, a mounting section 2 for an operating boom 4 mounted at a front portion of the frame 1, and an engine 3 placed at a rear portion of the frame 1. The boom 4 includes a swing bracket **4*a* mounted on the mounting section 2. The boom 4 is swung leftwardly and rightwardly by a swing cylinder 5 mounted at a right-hand side portion of the frame 1 and is pivoted upwardly and downwardly by a boom cylinder 6 interposed between the swing bracket 4*a* and an intermediate portion 4*b* of the boom 4. An arm 7 is mounted at an end portion 7*a*** thereof for pivotal motion at an end 4c of the boom 4 such that it is pivoted upwardly and downwardly by an arm cylinder 8 interposed between the intermediate portion 4b of the boom 4 and the end portion 7a of the arm 7. A bucket 9 is mounted for pivotal motion at the other end 7b of the arm 7 such that the bucket 9 is pivoted by a bucket cylinder 10.

A transmission case 11 is securely mounted on the frame 1 below the engine 3. A drive shaft 12 extends from the opposite sides of the transmission case 11, and a pair of drive sprocket wheels 13 are mounted at the opposite left and right end portions of the drive shaft 12. A pair of driven wheels 14 are mounted for rotation at left and right portions of a lower front portion of the frame 1, and a pair of crawlers 15 extend between and around the driven wheels 14 and the driving sprocket wheels 13.

A support element or portion 18 for a support post 17 for a seat 16 is mounted on and extends obliquely rearwardly upwardly from a rear wall of the transmission case 11, and the support post 17 is mounted for forward pivotal motion on the support portion 18. A bracket 19 is also mounted on and extends rearwardly from a lower portion of the transmission case 11, and a step plate 20 is mounted for pivotal motion on the bracket 19 such that it may be folded as indicated by chain lines when it is not to be used.

When the very small size shovel car S is to be operated, an operator is first seated on the seat 16 with his feet placed on the step plate 20 and then operates a pair of running levers 21 to drive the crawlers 15 to move the shovel car S to move forwardly or backwardly, and when an excavating operation is to be performed, the boom 4, arm 7 and bucket 9 are operated by way of a pair of operating levers 22.

However, the seat 16 which extends rearwardly from the frame 1 sometimes makes an obstruction to an operation depending upon operating conditions. In such case, the seat 16 and the step plate 20 are folded as indicated in phantom in FIGS. 2 and 1, respectively, and the operator stands behind the car body and performs such operation as described above.

Figure 2:
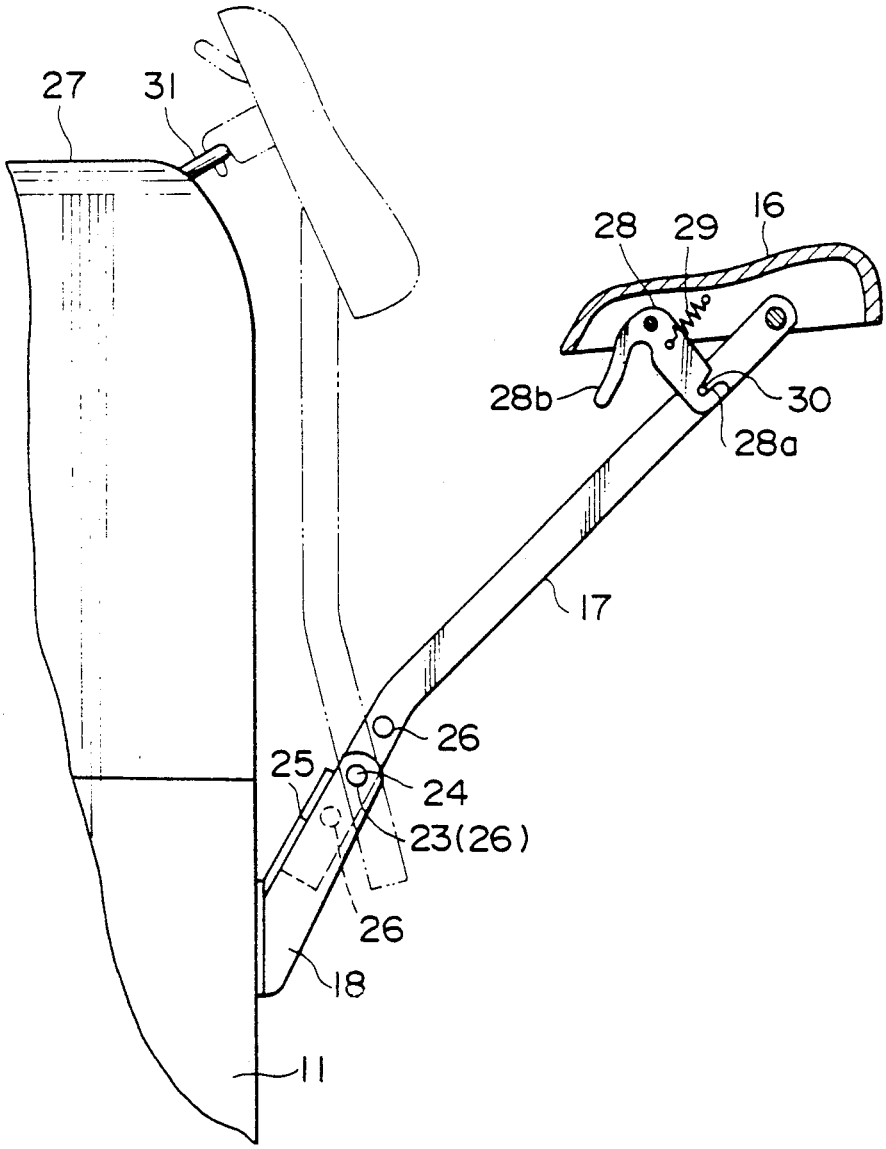
FIG. 2 is an enlarged side elevational view, partly broken, showing the seat device mounted on the very small size shovel car shown in FIG. 1.

Referring now to FIG. 2, construction of the seat 16, support post 17 and support portion 18 is shown more in detail. The support post 17 is mounted for pivotal motion in forward and backward directions between an operative position and an inoperative position indicated by solid lines and in phantom in FIG. 2, respectively, around a horizontal axis provided by a pin 24 which is inserted in a hole 23 perforated at an upper end portion of the support portion 18 mounted on the rear wall of the transmission case 11. A lower end portion of the support post 17 abuts with and is held by a stopper 25 securely provided on a front side of the support portion 18 to limit rearward pivotal motion of the support post 17 to stop the seat 16 at a predetermined position. The support post 17 has a plurality of, three in the embodiment shown, pin fitting holes 26 perforated therein. Thus, the height or vertical location of the seat 16 can be adjusted by aligning an arbitrary one of the pin fitting holes 26 with the hole 23 of the support portion 18 and fitting the pin 24 into the thus aligned pin fitting hole 26 and hole 23. Since the support portion 18 and the stopper 25 extend obliquely upwardly rearwardly, when the height or vertical location of the seat 16 is adjusted, also the distance between the seat 16 and a bonnet 27 of the shovel car S is adjusted simultaneously so that a knee of a tall operator will not interfere with the bonnet 27.

The seat 16 is mounted at an inner portion thereof for pivotal motion at an upper end of the support post 17. An L-shaped lever 28 is mounted for pivotal motion at another inner portion of the seat 16 and is normally urged in the counterclockwise direction in FIG. 2 by a spring 29. The lever 28 has a hook 28a formed provided at a free end portion thereof such that an arresting pin 30 mounted on a side face of the support post 17 is received in the hook 28a to secure the seat 16 at a predetermined angular position with respect to the support post 17.

However, when the seat 16 is not to be used, the other end portion 28b of the lever 28 is grasped by hand and pivoted in the clockwise direction in FIG. 2 to disengage the hook 28a of the lever 28 from the arresting pin 30, and then the seat 16 is pivoted in the clockwise direction in FIG. 2 to raise the front portion thereof upwardly. Subsequently, the support post 17 is pivoted forwardly to the inoperative position in which it extends vertically upwardly along the bonnet 27 as indicated in phantom in FIG. 2, and then the lever 28 is pivoted in the counterclockwise direction until the hook 28a thereof is engaged with a U-shaped bolt 31 mounted at an upper portion of the bonnet 27 to secure the seat 16 with respect to the bonnet 27. On the other hand, when the seat 16 is to be used, the procedure described above is performed reversely. Thus, the lever 28 is manually operated to be disengaged from the U-shaped bolt 31 and the support post 17 is tilted rearwardly, whereafter the hook 28a of the lever 28 is engaged with the arresting pin 30 of the support post 17, thereby completing setting of the seat 16.

Figure 3:
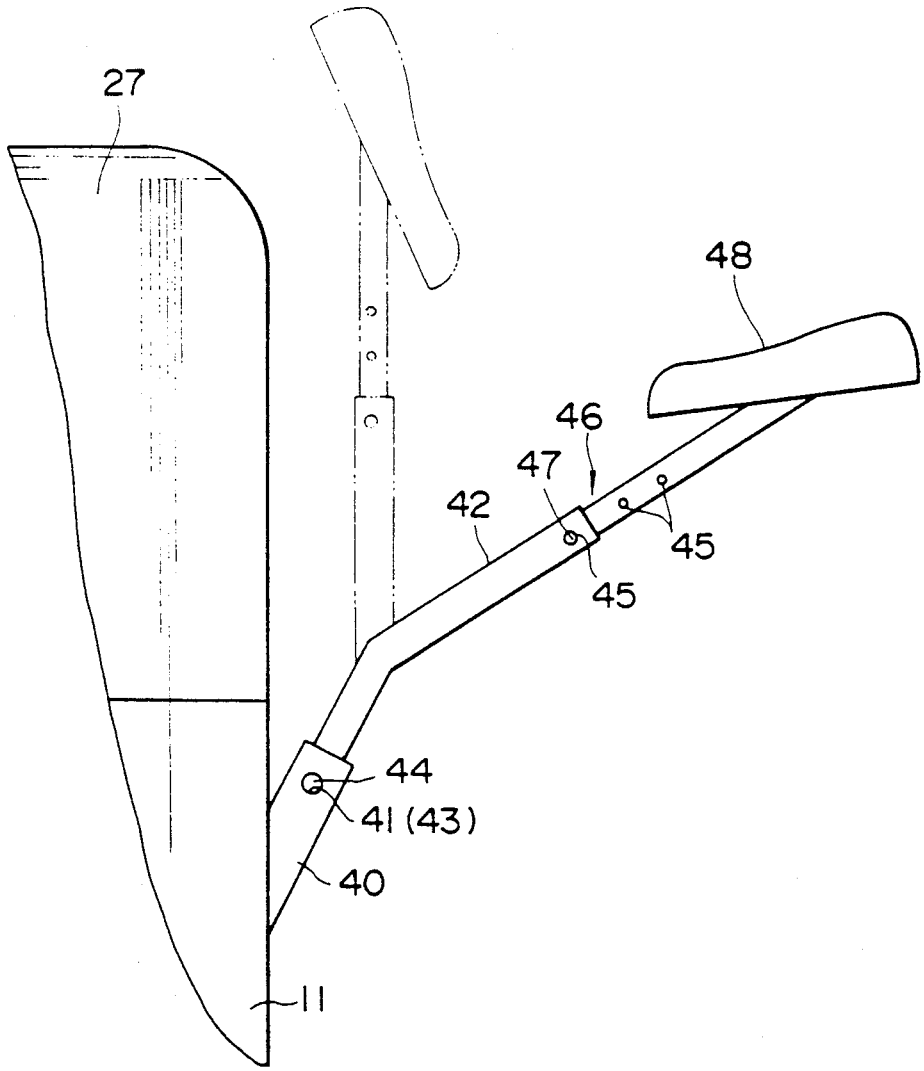
FIG. 3 is a similar view but showing another seat device to which the present invention is applied.

Referring now to FIG. 3, there is shown a seat device according to another embodiment of the present invention. A support portion 40 here has the form of a pipe, and a hole 41 is perforated in the support portion 40 and extends horizontally in a leftward and rightward direction while a pin fitting hole 43 corresponding to the hole 41 is perforated at a lower portion of a support post 42. A pin 44 is inserted in the hole 41 and pin fitting hole 43 to secure the support post 42 to the support portion 40.

The support post 42 is bent rearwardly at an intermediate portion thereof, and a slide element 46 is fitted for axial sliding movement in a top portion of the support post 42. The support post 42 has a horizontal hole formed therein while the slide element 46 has a plurality of, three in the embodiment shown, holes 45 perforated therein, and an adjusting pin 47 is inserted in the hole of the support post 42 and one of the holes 45 of the slide element 46 registered with the hole of the support post 42 to secure the slide element 46 and hence a seat 48 securely mounted at the top end of the slide element 42 with respect to the support post 42. Thus, the height or vertical position of the seat 48 can be adjusted suitably by selecting a suitable one of the holes 45 of the slide element 46 which is to be registered with the hole of the support post 42 so as to allow the adjusting pint 47 is to be inserted in position.

When the seat 48 is not to be used, the pin 44 of the support post 40 is first pulled off the support portion 40 and then the support post 42 is pivoted by 180 degrees either in the clockwise or counterclockwise direction around an obliquely rearwardly inclined axis of the support post 42 provided by the support element 40 from an operative position indicated by solid lines to an inoperative position indicated in phantom in FIG. 3. Thereupon, the seat 48 is turned over in a forward and backward direction as indicated by chain lines and the pin fitting hole 43 of the support plate 42 is registered with the hole 41 of the support portion 40. Then, the pin 44 is inserted into the thus registered hole 41 and pin hitting hole 43 thereby to secure the seat 48 with respect to the transmission case 11. The orientation of the support portion 40 and the bent angle of the support post 42 may be suitably determined from the overall length of the support post 42, the position of the seat 48 at which an operator is to be seated on the seat 48, the pivoted position of the support post 42 and so forth.

Having now fully described the invention, it will be apparent to one of ordinary skill in the art that many changes and modifications can be made thereto without departing from the spirit and scope of the invention as set forth herein.

What is claimed is:

1. A seat device on a very small size shovel car comprising:

a car body;

an operating boom mounted for pivotal motion on a front portion of the car body;

an engine and a transmission case mounted on a rear portion of said car body;

a support element mounted at a rear lower portion of said car body;

a support post having a seat secured to the top end thereof, said support post being mounted on said support element for motion between an operative position in which said support post is directed upwardly and rearwardly and a seat face of said seat is directed upwardly to allow an operator to be seated thereon, and an inoperative position in which said support post extends vertically upwardly along said car body of said shovel car and said seat face of said seat is directed rearwardly; and securing means for securing said support post at the operative and inoperative positions.

2. A seat device on a very small size shovel car according to claim 1, wherein said support post is mounted for pivotal motion between the operative and inoperative positions around a horizontal axis at a top end portion of said support element.

3. A seat device on a vary small size shovel car according to claim 2, wherein said securing means includes stopper means provided on a forward portion of said support element for securing said support post at the operative position.

4. A seat device on a very small size shovel car according to claim 2, wherein said seat is pivotally mounted to said support post and said securing means includes a manually operable lever mounted for pivotal motion on said seat, an arresting pin provided on said support post for engaging with said lever to hold said seat face directed upwardly when said support post in the operative position, and another arresting member provided on said car body for engaging with said lever to hold said support post in the inoperative position.

5. A seat device on a very small size shovel car according to claim 2, wherein said support element has a horizontal hole formed therein while said support post has a plurality of holes formed in a predetermined spaced relationship therein, and said support post is supported for pivotal motion around a pin which is inserted in said hole of said support element and an arbitrary one of said support post holes which is aligned with said hole of said support element, said holes of said support post providing different vertical positions of said seat with respect to said car body.

6. A seat device on a very small size shovel car according to claim 1, wherein said support post is supported on said support element for pivotal motion between the operative and inoperative positions around an obliquely rearwardly inclined axis provided by said support element.

7. A seat device on a very small size shovel car according to claim 6, wherein an upper portion of said support post is bent obliquely laterally with respect to a lower portion of said support post which lower portion extends along the obliquely rearwardly inclined axis.

8. A seat device on a very small size shovel car according to claim 6, wherein said support element has a horizontal hole formed therein while said support post has a corresponding hole formed therein, and said securing means includes a pin adapted to be inserted in said holes of said support element and support post aligned with each other in either of two positions mutually spaced by 180°, to secure said support post to each of the operative and inoperative positions.

9. A seat device on a very small size shovel car according to claim 6, wherein said support post includes a first member supported on said support element, and a second member mounted for relative movement on said first member and secured at a selected one of a plurality of positions with respect to said first member by fixing means, said seat being securely mounted on said second member.

10. A seat device on a very small size shovel car according to claim 9, wherein said first member of said support post has a hole formed therein while said second member has a plurality of holes formed in a predetermined spaced relationship therein, and said fixing means includes a pin inserted in said hole of said first member and an arbitrary one of said holes of said second member, said holes of said second member providing a plurality of vertical positions of said seat with respect to said car body.

* * * * *